US006670749B2

(12) United States Patent
Inoue et al.

(10) Patent No.: US 6,670,749 B2
(45) Date of Patent: Dec. 30, 2003

(54) ELECTROLUMINESCENT DEVICE

(75) Inventors: Takashi Inoue, Kuwana-gun (JP); Masayuki Katayama, Handa (JP); Hiroshi Kondo, Nagoya (JP)

(73) Assignee: Denso Corporation, Kariya (JP)

( * ) Notice: Subject to any disclaimer, the term of this patent is extended or adjusted under 35 U.S.C. 154(b) by 29 days.

(21) Appl. No.: 10/006,210

(22) Filed: Dec. 10, 2001

(65) Prior Publication Data

US 2002/0130613 A1 Sep. 19, 2002

(30) Foreign Application Priority Data

Mar. 14, 2001 (JP) ..... 2001-072448

(51) Int. Cl.[7] ..... H01J 63/04

(52) U.S. Cl. ..... 313/506

(58) Field of Search ..... 313/498, 505, 313/506, 509, 512; 315/169.3

(56) References Cited

U.S. PATENT DOCUMENTS

| | | | | |
|---|---|---|---|---|
| 4,486,487 A | | 12/1984 | Skarp | |
| 5,789,860 A | | 8/1998 | Inoguchi et al. | |
| 6,137,222 A | * | 10/2000 | Ishihara et al. | 313/506 |
| 6,207,302 B1 | | 3/2001 | Sugiura et al. | |

* cited by examiner

*Primary Examiner*—Vip Patel
(74) *Attorney, Agent, or Firm*—Posz & Bethards, PLC

(57) ABSTRACT

An EL device is constructed of an insulating substrate, and a first electrode, a first insulating layer, a luminescent layer, a second insulating layer and a second electrode, which are laminated on the insulating substrate in this order. The insulating layer is made by a method other than ALE, for example, sputtering or vapor deposition. The second insulating layer includes alternating layers of $Al_2O_3$ and $TiO_2$, which are formed by ALE. The second insulating layer covers the luminescent layer and an end surface of the first insulating layer. Since the first insulating layer is not formed by ALE, the device can be manufactured with high productivity, and there is no less of performance compared to a device having two ALE insulation layers.

10 Claims, 2 Drawing Sheets

ELECTROLUMINESCENT DEVICE

CROSS REFERENCE TO RELATED APPLICATIONS

This application is based upon and claims the benefit of Japanese Patent Application No. 2001-72448 filed on Mar. 14, 2001, the contents of which are incorporated herein by reference.

BACKGROUND OF THE INVENTION

1. Field of the Invention

The present invention relates to electroluminescent devices (referred to herein as EL devices) that are used for various instruments of emissive-type segment displays and matrix displays, displays of various information terminals, and the like. The present invention also relates to methods for producing the same.

2. Related Art

An EL device is typically formed by laminating first electrodes, a first insulating layer, a luminescent layer, a second insulating layer, and second electrodes on an insulating glass substrate in this order. The first and the second insulating layers are made of silicon dioxide ($SiO_2$), silicon nitride (SiN), silicon oxynitride (SiON), sitantalum pentaoxide ($Ta_2O_5$) or the like, and formed by sputtering, vapor deposition or the like.

It is, however, difficult to provide insulating layers that are formed by sputtering or vapor deposition with sufficient insulating performance (ability to withstand voltage) and sufficient water resistance over the entire area of the display panel of the EL device.

Therefore, to increase the insulating performance and the water resistance performance, JP-A-58-206095 and JP-A-10-308283 propose that the first and the second insulating layers have an aluminum oxide ($Al_2O_3$) and titanium oxide ($TiO_2$) laminated structure (referred to as the $Al_2O_3$ and $TiO_2$ laminated layer herein). The laminated structure is formed by alternately laminating $Al_2O_3$ layers and $TiO_2$ layers by ALE (Atomic Layer Epitaxy).

In this case, each of the $Al_2O_3$ layers is an insulator, and each of the $TiO_2$ layers is a semiconductor. Accordingly, the first and the second insulating layers have high insulating performance and high water resistance.

However, ALE involves stacking atomic layers one by one. Therefore, ALE for forming the first and the second insulating layers takes more time than sputtering or vapor deposition, which limits productivity.

SUMMARY OF THE INVENTION

It is therefore an object of the present invention to provide an EL device that fosters high productivity and a method that increases productivity.

To achieve the above-mentioned object, an EL device according to the present invention includes a first insulating layer made by a method other than ALE, for example, sputtering or vapor deposition, and a second insulating layer made by ALE. The second insulating layer covers an end surface of the first insulating layer.

Accordingly, the EL device has a high insulating performance and a high water resistance. Further, in this EL device, the total time for forming the first and the second insulating layers is reduced, which increases productivity.

BRIEF DESCRIPTION OF THE DRAWINGS

Other objects, features and advantages of the present invention will be understood more fully from the following detailed description made with reference to the accompanying drawings. In the drawings.

DETAILED DESCRIPTION OF THE PREFERRED EMBODIMENT

Figure 1:
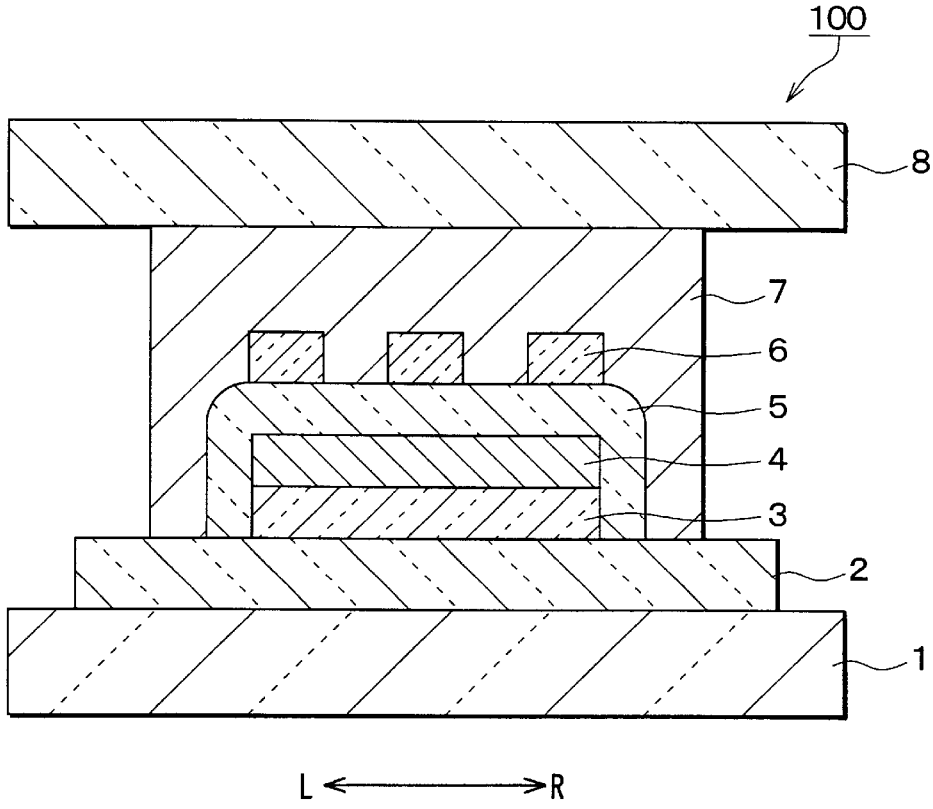
FIG. 1 is a cross-sectional view of an EL device according to the present invention.

As shown in FIG. 1, an EL device 100 is constructed of an insulating substrate 1, a plurality of first electrodes 2, a first insulating layer 3, a luminescent layer 4, a second insulating layer 5 and a plurality of second electrodes 6, which are laminated on the insulating substrate 1 in this order.

The insulating substrate 1 is formed, for example, by glass substrate. The first electrodes 2 are made of a transparent and conductive material, for example, ITO (Indium Tin Oxide), ZnO (Zinc Oxide) or the like. In this embodiment, the first electrodes 2 are made of ITO. The first electrodes 2 extend in the left to right direction of FIG. 1 and are parallel.

A first insulating layer 3 is made of metal oxide. The first insulating layer 3 is not made by ALE, but is made, for example, by sputtering or vapor deposition. The first insulating layer 3 is formed on and between the first electrodes 2. Preferably, the first insulating layer 3 includes four materials, that is, tantalum, tin, nitrogen and oxygen (TaSnON). In this embodiment, the TaSnON insulating layer 3 is formed by sputtering.

The luminescent layer 4 is made of inorganic material and is formed by vapor deposition or the like. In this embodiment, the luminescent layer 4 is made of zinc sulfide (ZnS) as a host material with manganese (Mn) as its luminescent center. The luminescent layer 4 may be made of ZnS as a host material with terbium (Tb) as its luminescent center or strontium sulfide as a host material with cesium (Ce) as its luminescent center. In those cases, the host materials are capable of luminescing in various colors.

The second insulating layer 5 is formed on the luminescent layer 4 and covers the luminescent layer 4 and an end surface of the first insulating layer 3. An $Al_2O_3$ and $TiO_2$ (ATO) laminated layer, an $Al_2O_3$ layer, or the like, which is made by ALE, may be used as the second insulating layer 5. In this embodiment, the second insulating layer is made of $Al_2O_3$ and $TiO_2$.

The second electrodes 6 may be made of the same material that forms the first electrodes 4. In this embodiment, each second electrode 6 is made of ITO and extends at a right angle to the first electrodes 6 as shown. The points where the first and the second electrodes 2, 6 overlap, or cross, form luminous pixels.

Further, a cover glass 8 is fixed on the second electrode 6 by an adhesive material 7. The adhesive material 7 may be thermoset resin, epoxy resin or the like.

In this EL device 100, parts of the luminescent layer 4 luminesce when a rectangular voltage wave (driving voltage) is applied between the corresponding first electrodes 2 and the second electrodes 6. In this embodiment, the light from the luminescent layer 4 radiates from both sides of the EL device 100 since both sides of the luminescent layer 4 are covered by transparent materials.

However, the light may be viewed from only one side of the EL device 100. Namely, the materials on the side that is not being viewed may be opaque. In this case, if a high reflectance material is applied to at least one of the materials on the side that is not being viewed, the light from the other side will be brighter.

A method of producing the EL device 100 will be described with reference to FIG. 1. First, ITO is applied to the insulating substrate 1 to form the first electrodes 2 by sputtering. For example, the thickness of the ITO is in the range of 200 to 1000 nm. Next, a layer of TaSnON is deposited on the first electrodes 2 to form the first insulating layer 3 by sputtering.

When depositing the TaSnON layer, $Ta_2O_5$ containing 1 to 20 mol % SnO (preferably 5 to 10 mol %) is used as a sputter target. Then, Argon gas including oxygen and nitrogen gas is introduced into a high frequency RF sputtering device as the sputtering gas, and the TaSnON layer is deposited by reactive sputtering.

The flow rate of the nitrogen into the device is greater than that of the oxygen. Preferably, the ratio of the flow rate of the nitrogen to that of the oxygen is more than two. Thus, for example, a TaSnON layer that is 300 to 1000 nm thick is deposited as the first insulating layer 3.

The luminescent layer 4, which is made of ZnS and Mn, is deposited on the first insulating layer 3. For example, the thickness of the luminescent layer 4 is in the range of 700 to 1200 nm. Then, the ATO layer is deposited on the luminescent layer 4 by ALE to form the second insulating layer 5.

In detail, as a first step, an $Al_2O_3$ layer is formed on the luminescent layer 4 by ALE using aluminum trichloride ($AlCl_3$) gas and water vapor ($H_2O$). The $AlCl_3$ gas and the water vapor serve as source gases for aluminum (Al) and oxygen (O), respectively. The source gases are introduced into a forming chamber alternately so that only one atomic layer is formed at a time. That is, the $AlCl_3$ gas is introduced into the forming chamber with argon (Ar) carrier gas for one second. Then, the chamber is purged so that the $AlCl_3$ gas in the chamber is sufficiently ventilated. Next, the water vapor is introduced into the chamber with the Ar carrier gas for one second. Then, the chamber is purged so that the water vapor in the chamber is sufficiently ventilated. The $Al_2O_3$ layer is formed with a desired thickness by repeating the above-mentioned cycle.

As a second step, a $TiO_2$ layer is formed on the $Al_2O_3$ layer using titanium tetrachloride ($TiCl_4$) gas and water vapor. The $TiCl_4$ gas and the water vapor serve as source gases for titanium (Ti) and oxygen, respectively. As in the first step, first, the $TiCl_4$ gas is introduced into the forming chamber with the Ar carrier gas for one second. Then, the chamber is purged so that the $TiCl_4$ gas in the chamber is sufficiently ventilated. Next, the water vapor is introduced into the chamber with the Ar carrier gas for one second. Then, the chamber is purged so that the $H_2O$ vapor in the chamber is sufficiently ventilated. The $TiO_2$ layer is formed with a desired thickness by repeating the above-mentioned cycle.

The ATO layer is formed with the desired thickness by repeating the first and the second steps for an appropriate time to produce the second insulating layer 5. In this embodiment, the $Al_2O_3$ and $TiO_2$ layers are alternately laminated until 36 layers are formed. The thickness of each of the $Al_2O_3$ and $TiO_2$ layers is preferably 5 nm. The top and the bottom layers of the $Al_2O_3$ and $TiO_2$ laminated layer may be either the $Al_2O_3$ layer or $TiO_2$ layer.

Next, ITO is formed on the second insulating layer 5 to form the second electrodes 6. For example, the thickness of the ITO is in the range of 100 to 5000 nm. The cover glass 8 is fixed to the second electrodes 6 by using the adhesive material 7. Thus, the EL device 100 shown in FIG. 1 is completed.

According to this embodiment, the second insulating layer 5 covers the luminescent layer 4 and the first insulating layer 3. Accordingly, the second insulating layer 5 tends to be exposed to water, and the luminescent layer 4 and the first insulating layer 3 are protected from exposure.

Thus, in this embodiment, the second insulating layer 5 is formed by ALE, and the first insulating layer 3 is formed by a method other than ALE. The insulating layer 5 that is formed by the ALE method has a superior insulating performance and superior water resistance to that formed by the non-ALE method. Therefore, the EL device 100 has good insulating performance and can resist water (e.g., the water included in the adhesive material 7) with the second layer 5 even if the first insulating layer 3 is formed by the non-ALE method. As a result, water cannot reach the luminescent layer 4.

On the other hand, the non-ALE method takes less time than ALE. Therefore, the time it takes to form the first insulating layer 3 is less than that of the second layer, which is formed by ALE, even if the first insulating layer is relatively thick to improve the insulating performance and water resistance.

As a result, the insulating performance and the water resistance of the device 100 are just as good as those of a device in which both the first and the second insulating layers 3, 5 are formed by ALE, and the total time to produce of the first and the second insulating layers 3, 5 is reduced.

For example, the time it takes to form the ATO layer using ALE is four or more hours, and a metal oxide layer formed by sputtering or vapor deposition is a few minutes, depending on the usage of the forming device. Thus, if both the first and the second insulating layers 3, 5 are formed by ALE, the total forming time will be eight or more hours. However, in this embodiment, the total forming time is about a half of that, which improves productivity.

Further, the ATO layer that forms the second insulating layer 5 is under about 700 MPa of stress, but the first insulating layer 3 that is formed by sputtering or vapor deposition is under relatively little stress (up to about 100 MPa).

When the first and the second insulating layers 3, 5 are formed by ALE, it is possible that the insulating substrate 1 will be deformed by the stress. In this case, if the thickness of the first and the second insulating layers 3, 5 is reduced, the deformation problem is obviated. However, this decreases the insulating performance. As a result, the EL device 100 cannot employ high voltage for high luminance.

However, in this embodiment, the first insulating layer 3 is formed by the non-ALE method, which creates little stress, so the insulating substrate 1 has little tendency to deform. Therefore, the thickness restriction of the first and the second insulating layers is relaxed, and an EL device 100 with high luminance results.

Furthermore, it is assumed that the capacitance of the TaSnON layer as the first insulating layer 3 is Cl and the capacitance of the ATO layer as the second insulating layer 5 is C2, the ratio of these two capacitances C2/C1 is preferably between 0.8 and 1.25 ($0.8 \leqq C1/C2 \leqq 1.25$).

When this capacitance ratio is satisfied, this EL device 100 has favorable drive characteristics, which are as good as those of a device in which the first and the second insulating layers 3, 5 are ATO layers. The characteristics will be described with reference to FIGS. 2 and 3.

Figure 2:
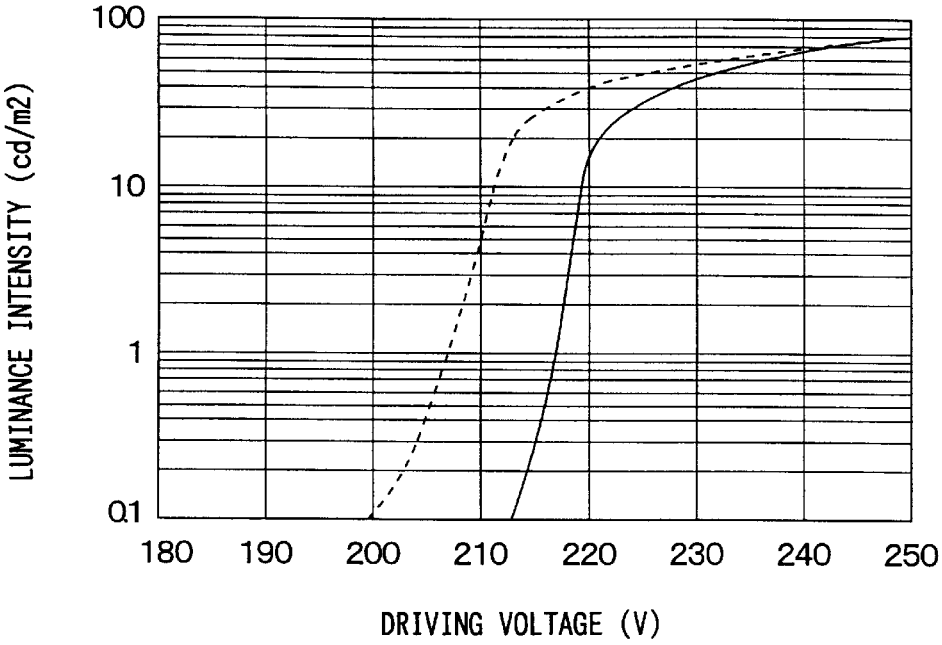
FIG. 2 is a graph illustrating driving voltage versus luminance of the EL device of the present invention and that of a reference device.
Figure 3:
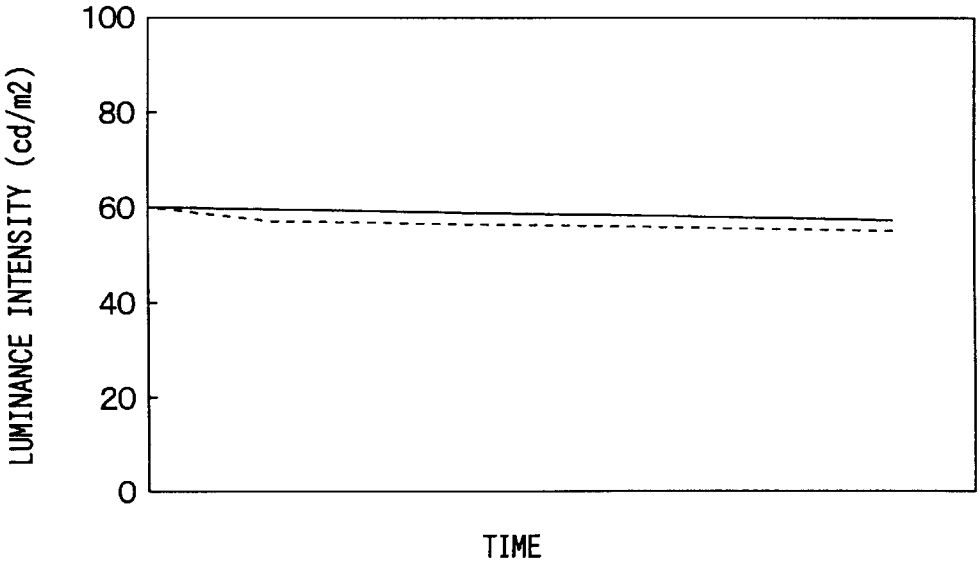
FIG. 3 is a graph illustrating driving time versus luminance characteristics of the EL device of the present invention and a reference device.

In the FIGS. 2 and 3, the solid line indicates the characteristics of an EL device 100 in which the ratio C1/C2 is between 0.8 and 1.25, and the broken line indicates the characteristics of a reference device. The first and the second insulating layers 3, 5 of the reference device are ATO layers. In FIG. 3, the driving time shown in the horizontal axis has no units. This is because the driving time varies according to driving frequency, pulse width, voltage, and temperature of the display. However, the luminance intensity of the EL device 100 of this embodiment and that of the reference device vary with time relatively as shown in FIG. 3.

As shown in FIGS. 2 and 3, the EL device 100 of this embodiment, which satisfies the inequality $0.8 \leqq C1/C2 \leqq 1.25$, has driving characteristics that are as good as those of the reference device.

On the contrary, when the EL device 100 of this embodiment does not satisfy the above inequality, namely, the ratio is less than 0.8 ($0.8 \geqq C1/C2$) or is more than 1.25 ($C1/C2 \geqq 1.25$), the degree of electro charge of the luminescent layer 4 from the side of the first insulating layer 3 (the side of the capacitance C1) and that from the side of the second insulating layer 5 (the side of the capacitance C2) become asymmetric. In this case, when the rectangular voltage wave (driving voltage) is applied between the first and the second electrodes 2, 6, the luminance when the voltage is positive and the luminance when the voltage is negative are greatly different from each other. Therefore, the starting luminous voltage becomes lower and the saturated luminance becomes lower. This causes display in burn-out, unevenness, and reduced luminance intensity.

Also, the capacitance C1 and the capacitance C2 are preferably between 20 to 60 nF/cm$^2$. When these values are less than 20 nF/cm$^2$, the driving voltage becomes higher than usual (e.g., 200 to 300 V). Thus, a driving IC that can generate high voltage is needed, and the cost of the driving circuit increases. When these values are more than 60 nF/cm$^2$, the insulating performance of the first and the second insulating layers 3, 5 becomes insufficient, and the first and the second insulating layers 3, 5 are liable to bring about a breakdown.

As mentioned above, the first insulating layer 3 is preferably made of insulating material including four materials, that is, tantalum, tin, nitrogen and oxygen. This makes it hard for the insulating layer 3 to react with the first electrodes 2 (the ITO material or the like) and the luminescent layer 4, which are adjacent. That is, the insulating layer 3 is chemically stable (See JP-A-9-11567).

In accordance with the relationship between two capacitances C1, C2 and the insulating performance, the thickness of the insulating layer 3 (the TaSnON layer) is preferably 300 to 1000 nm and the thickness of each of the $Al_2O_3$ layers and the $TiO_2$ layers of the second insulating layer 5 (the ATO layer) is preferably 0.5 to 100 nm (more preferably, 1 to 10 nm). This is because the insulating layer 3 does not function as an insulator when the thickness of each of the $Al_2O_3$ layers and the $TiO_2$ layers is less than 0.5 nm. On the other hand, the insulating performance by the laminated structure is maximized when the thickness of each of the $Al_2O_3$ layers and the $TiO_2$ layers is more than 100 nm.

The EL device 100 of this embodiment is applied to a display panel when arranged in matrix shape or the like.

What is claimed is:

1. An electroluminescent device comprising:

a first electrode;

a first insulating layer formed by a method other than Atomic Layer Epitaxy (ALE) and laminated on the first electrode;

a luminescent layer laminated on the first insulating layer;

a second insulating layer formed by ALE, laminated on the luminescent layer, and having a laminated structure including a plurality of layers of a first type and a plurality of layers of a second type, wherein the layers of the first type are laminated alternately with the layers of the second type, the layers of the first type are insulators, the layers of the second type are semiconductors and an end surface of the first insulating layer is covered by the second insulating layer;

a second electrode laminated on the second insulating layer; and an insulating substrate, wherein the first electrode, the first insulating layer, the luminescent layer, the second insulating layer, and the second electrode are laminated to the insulating substrate such that the insulating substrate is adjacent to the first electrode.

2. An electroluminescent device of claim 1, further comprising a cover glass that is adhered to the second electrode with an adhesive material, wherein the first insulating layer is separated from the adhesive material by the second insulating layer.

3. An electroluminescent device of claim 1, wherein the first insulating layer includes tantalum, tin, nitrogen and oxygen.

4. An electroluminescent device of claim 1, wherein the first insulating layer is formed by one of sputtering and vapor deposition.

5. An electroluminescent device of claim 1, wherein the ratio of the capacitance of the first insulating layer C1 to the capacitance of the second insulating layer C2 is within 0.8 to 1.25.

6. A device according to claim 1, wherein the first electrode is one of a plurality of first parallel electrodes.

7. A device according to claim 6, wherein the second electrode is one of a plurality of second parallel electrodes.

8. An electroluminescent device of claim 1, wherein the layers of the first type comprise $Al_2O_3$ layers and the layers of the second type comprise $TiO_2$ layers.

9. An electroluminescent device comprising:

a first electrode;

a first insulating layer including tantalum, tin, nitrogen and oxygen, formed by a method other than ALE and laminated on the first electrode;

a luminescent layer laminated on the first insulating layer;

a second insulating layer formed by Atomic Layer Epitaxy (ALE) and laminated on the luminescent layer; and a second electrode laminated on the second insulating layer.

10. An electroluminescent device comprising:

a first electrode;

a first insulating layer formed by a method other than Atomic Layer Epitaxy (ALE) and laminated on the first electrode;

a luminescent layer laminated on the first insulating layer;

a second insulating layer formed by ALE and laminated on the luminescent layer, wherein a ratio of a capacitance of the first insulating layer C1 to a capacitance of the second insulating layer C2 is within a range of 0.8 to 1.25; and a second electrode laminated on the second insulating layer.

* * * * *